United States Patent [19]

Bock

[11] 4,345,719

[45] Aug. 24, 1982

[54] WATER AERATOR

[75] Inventor: Robert E. Bock, Woodbury, Conn.

[73] Assignee: WPM, Inc., Waterbury, Conn.

[21] Appl. No.: 135,352

[22] Filed: Mar. 31, 1980

[51] Int. Cl.[3] ..... E03C 1/084

[52] U.S. Cl. ..... 239/428.5; 138/42; 138/44; 239/600

[58] Field of Search ..... 239/428.5, 553.3, 553.5, 239/590.3, 590.5, 600, DIG.18; 138/41–45; 261/DIG. 22

[56] References Cited

U.S. PATENT DOCUMENTS

| | | | |
|---|---|---|---|
| 2,316,832 | 4/1943 | Aghnides | 239/428.5 |
| 2,741,467 | 4/1956 | Lee et al. | 239/428.5 |
| 3,138,332 | 6/1964 | Hinderer | 239/428.5 |
| 3,623,670 | 11/1971 | Wakeman | 239/428.5 |
| 3,630,455 | 12/1971 | Parkison | 138/45 |
| 3,684,191 | 8/1972 | Shames et al. | 239/428.5 |
| 4,221,338 | 9/1980 | Shames et al. | 239/428.5 |

*Primary Examiner*—Robert B. Reeves
*Assistant Examiner*—Michael J. Forman
*Attorney, Agent, or Firm*—Cyrus S. Hapgood

[57] ABSTRACT

Within a cylindrical barrel to be secured to the water faucet are a basket surrounding a mixing chamber, a diffuser overlying the mixing chamber and forming a diffusing chamber, having peripheral openings for flow of water to the mixing chamber, and a flow restrictor disc having a control opening for admitting water from said faucet to the diffusing chamber, the diffuser having resilient detents allowing the disc to be snapped into position on a seat of the diffuser where the disc is releasably retained by the detents. Preferably, a ring surrounds and supports the diffuser and forms therewith a passage for flow of water from the diffuser openings to the mixing chamber, the ring being supported on part of the basket.

17 Claims, 1 Drawing Figure

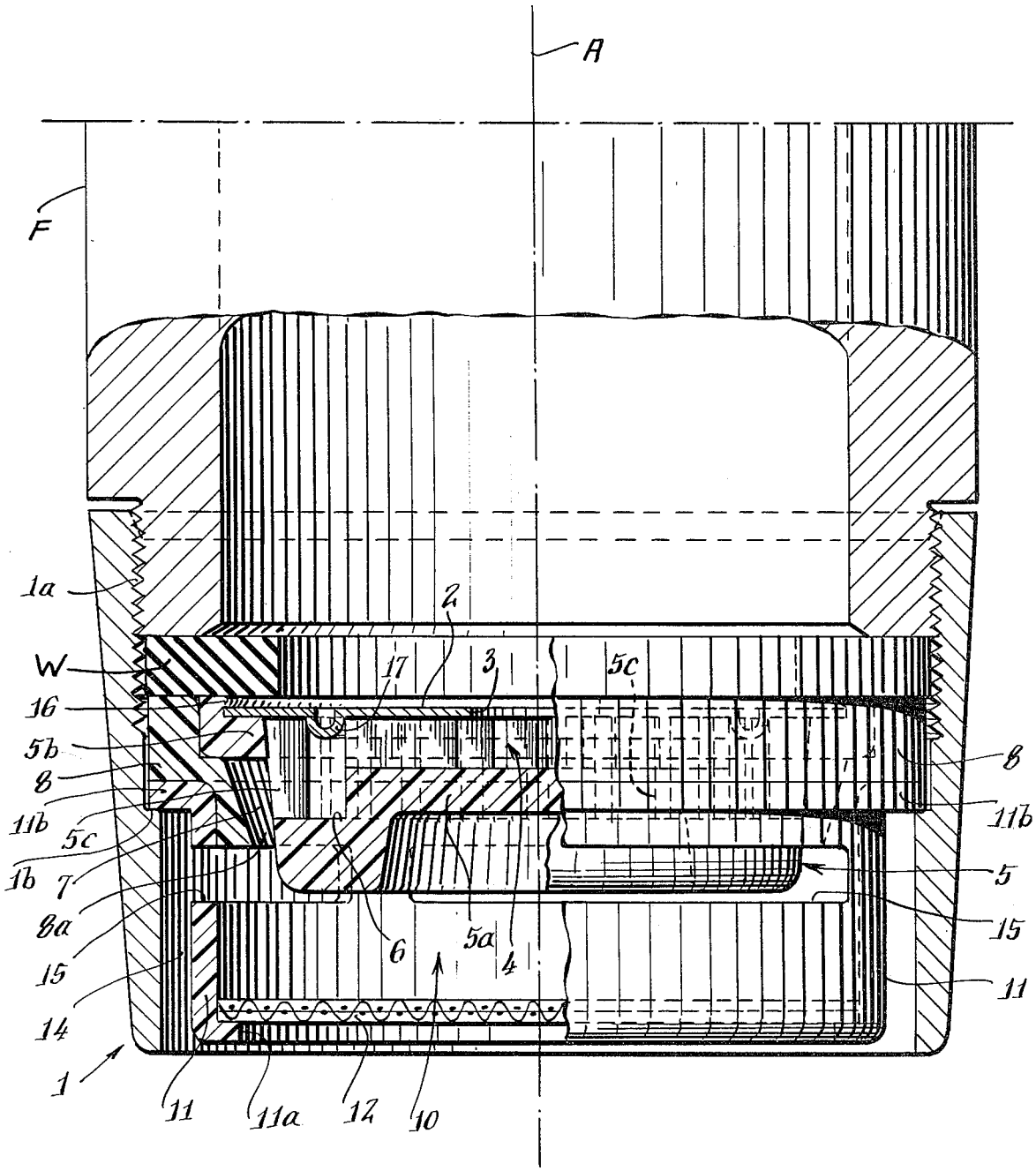
A
F
1a
W
16
5b
8
11b
5c
1b
7
8a
15
14
1
11
11a
12
10
6
5a
4
17
2
3
5c
8
11b
5
15
11

WATER AERATOR

This invention relates to liquid aerators and more particularly to a water aerator adapted to be secured to a faucet.

In aerators of the type involved here, water under pressure from the faucet enters a diffuser mounted in a cylindrical casing or barrel releasably secured to the faucet. The diffuser breaks up the flow into fine jets which are directed downward into a chamber where they are mixed with air, an aerated bubbly stream being finally discharged through a screen located in the discharge end of the barrel and supported by a basket surrounding the mixing chamber. The action of the water jets maintains a subatmospheric pressure in the mixing chamber, thereby drawing air into this chamber by way of a passage defined by the basket and the surrounding barrel.

It has been proposed heretofore to limit the flow rate into the aerator by means of a flow restricting disc having a control opening through which the water from the faucet must pass to enter the diffuser. However, prior aerators having such a disc suffer certain disadvantages. Among these is the inability to allow the disc to be assembled into the aerator readily and even automatically, and at the same time to retain the disc against accidental displacement while allowing easy removal of the disc in cases where a full flow rate is desired. Also, by arranging the disc to extend to the inside diameter of the cylindrical casing or barrel, water from within the aerator can reach the threads of the barrel (if it is internally threaded) and leak between these threads and the external threads of the faucet.

The principal object of the present invention is to provide a water aerator which overcomes the above-noted disadvantages.

In an aerator made according to the invention, the diffuser forms a diffusing chamber having peripheral openings for flow of water outwardly and downwardly into the mixing chamber, and the diffuser has a seat recessed below to the top of the diffuser. The diffuser also has means for releasably retaining the restrictor disc against removal from this seat while allowing the disc to be snapped into position on the seat. Preferably, such retaining means consist of resilient detents located on a flange of the diffuser and overlying the outer edge portion of the disc.

The preferred form of the new aerator also comprises a ring surrounding and supporting the diffuser and forming therewith a passage for flow of water from the peripheral openings of the diffuser to the mixing chamber. Preferably, a flexible washer engages the upper surfaces of the ring and diffuser so that it is compressed against these surfaces when the aerator casing or barrel is secured to the faucet. In this way, water cannot reach internal threads on the barrel from the interior of the aerator.

For a better understanding of the invention, reference may be had to the following description in conjunction with the accompanying drawing, in which the single illustration is a vertical sectional view of a preferred form of the new aerator.

The illustrated form of the new aerator comprises a cylindrical barrel 1 which is internally threaded at its upstream end, as shown at 1*a*, whereby the barrel can be readily connected to or disconnected from the externally threaded outlet end of a water faucet F. Water under pressure in faucet F flows against the upper surface of a circular flow restrictor 2 and through an opening 3 which is concentric to the central vertical axis A of the aerator. The independent jet thus formed is directed downwardly into a diffusing chamber 4 within a circular diffuser element 5. The latter has a raised bottom portion 5*a* surrounded by an annular trough 6 and also has at its upper portion an annular outwardly-extending flange 5*b* forming a recessed seat for restrictor 2. The annular side wall of diffuser 5 is provided with a series of vertical slots 5*c* spaced evenly around the diffuser and extending from the upper portion of the side wall to the bottom level of trough 6.

Water from diffusing chamber 4 passes radially outward through slots 5*c*, further diffusing the water, and thence into an annular passage 7 formed between the side wall of diffuser 5 and a surrounding ring 8. The jets of water from slots 5*c* are still further diffused in passage 7 and then discharged downwardly into a mixing chamber 10. The bottom of ring 8 is provided with a sharp annular edge 8*a* which acts upon the jets of discharging water to diffuse them further into a fine spray.

Mixing chamber 10 is located within a basket 11 having a central bottom opening surrounded by an inwardly extending annular flange 11*a*. The latter supports a pair of fine screens 12. At its upper portion, basket 11 has an outwardly extending annular flange 11*b* resting upon an internal annular seat 1*b* of the barrel 1. The side wall of basket 11 is spaced from the surrounding wall of barrel 1 so as to form an annular passage 14 open at the bottom and closed at the top by flange 11*b*. Passage 14 communicates with the upper part of mixing chamber 10 through horizontally-extending slots spaced around the side wall of basket 11, one of these slots being shown at 15.

As will be readily apparent to those skilled in the art, the jet action of the fine spray descending from the annular inner passage 7 creates a negative static pressure in mixing chamber 10. As a result, atmospheric air is sucked up through the outer annular passage 14 and enters chamber 10 through the basket slots 15. The water and air mixed in chamber 10 are discharged downwardly through the fine screens 12, which retard the flow somewhat and further contribute to the mixing to produce an aerated, soft, bubbly stream of liquid issuing from the aerator.

The annular flange 5*b* of diffuser 5 has an upwardly extending portion surrounding the flow restrictor disc 2 and also has three detents equally spaced around the top of the flange and overlying the outer edge portion of disc 2, one of these retaining detents being shown at 16. The detents 16 are sufficiently resilient to allow restrictor disc 2 to be snapped into position on diffuser 5; and yet they guard against accidental displacement of the disc from diffusor 5. The central hole 3 in disc 2 is dimensioned to effect a precise control of the flow rate through the aerator. In some instances, however, it may be preferred to remove this disc so as to provide a full flow rate, and detents 16 allow such removal. The detents 16 also allow automatic assembly of disc 2 into diffusor 5.

The central hole 3 in flow restrictor disc 2 is usually formed by a press-punching operation which results in a burr surrounding the hole at one side of the disc. In order for the hole 3 to control the flow rate precisely, it is necessary that disc 2 be installed with the burr side of the disc facing downward. So that its burr side can be readily detected, the disc is formed with an annular ridge 17 overlying the annular trough 6 and projecting downwardly from the disc's burr side. Ridge 17 also assists in centralizing the disc 2 as it is assembled into diffuser 5.

As shown, a washer W is compressed between the lower surface of faucet F and the upper surfaces of diffuser 5 and ring 8, thereby preventing water from reaching the barrel threads 1*a* and leaking out along the threads. The diffuser flange 5*b* fits snugly in the upper part of ring 8 and is supported on an annular internal seat of the ring, which in turn is supported on the basket flange 11*b*. The aerator parts can thus be readily assembled and disassembled.

It will be observed that the surface of ring 8 forming the outer confine of passage 7 is a conical surface slanting straight downward and inward to the sharp edge 8*a*. The combination of this conical section and sharp edge is believed to result in substantial improvement of the stream quality.

The aerator parts other than washer W are shown as being made of metal. However, plastics may be used for fabricating these other parts, especially the parts 5, 8 and 11.

It will also be observed that the aerator parts within the barrel 1 can be easily removed therefrom and separated from each other for cleaning when the barrel is detached from the faucet.

It should be noted that the diffuser flange 5*b* prevents leakage along threads 1*a* of the aerator. That is, water entering through disc hole 3 cannot leak to the outside of the aerator around the outer edge of disc 2 because the only possible leakage path to the threads 1*a* is along the lower surface of washer W, as shown in the drawing; and the latter path is closed by flange 5*b* when it compresses the washer as the aerator is screwed to the faucet F.

I claim:

1. In a water aerator for delivering an aerated bubbly stream, the combination of a cylindrical barrel adapted to be removably secured at its upper portion to a source of water under pressure, a basket mounted in the barrel and surrounding a mixing chamber, screen means supported by the basket below said chamber and through which said stream is adapted to be discharged, said barrel and basket having opposing parts forming a passage for flow of atmospheric air into the mixing chamber due to a reduced pressure therein, a diffuser overlying the mixing chamber and forming a diffuser chamber positioned to receive water from said source, the diffuser chamber being open at the top and having peripheral openings for diffusing a flow of water outwardly from the diffuser chamber to the mixing chamber, the diffuser also having a seat recessed below the top of the diffuser, a flow restrictor disc supported on said seat and having a control opening for admitting water from said source to the diffuser chamber, and means on the diffuser for releasably retaining said restrictor disc against removal from the diffuser, said control opening, diffuser chamber, peripheral openings and mixing chamber forming a path through which water is adapted to flow from said source to said screen means for discharge from the aerator.

2. The combination of claim 1, in which said releasable retaining means are detents overlying the outer portion of the disc.

3. The combination of claim 1, in which the diffuser has a peripheral flange at its upper portion surrounding said seat, said releasable retaining means being detents projecting from said flange and overlying the outer portion of the disc.

4. The combination of claim 1, comprising also a ring surrounding and supporting the diffuser and forming therewith an annular passage for flow of water from said diffuser openings to the mixing chamber.

5. The combination of claim 4, in which said ring is closely surrounded by the barrel.

6. The combination of claim 4, in which the basket has an outwardly extending flange seated on a portion of the barrel to support the basket, said ring being supported on said basket flange.

7. The combination of claim 4, comprising also a flexible washer engaging the upper surfaces of said diffuser and ring and adapted to be compressed by said water source when the barrel is secured thereto.

8. The combination of claim 1, comprising also a flexible washer located in said barrel above the diffuser and adapted to be compressed against said water source when the barrel is secured thereto, the diffuser having a peripheral flange surrounding said seat and engaging the washer when the restrictor disc is removed from the combination, said seat being recessed to a depth at least as great as the thickness of said disc, whereby the diffuser flange is engageable with the washer to compress the same against said source regardless of whether the restrictor disc is on said seat or is removed from the combination.

9. The combination of claim 1, comprising also a ring surrounding and supporting the diffuser and forming therewith an annular passage for flow of water from said diffuser openings to the mixing chamber, said ring being closely surrounded by the barrel, said basket having an outwardly extending flange seated on a portion of the barrel to support the basket, said ring being supported on said basket flange, and a flexible washer overlying an annular outer portion of the diffuser and engaging the upper end of said ring, said washer being compressible by said ring against said water source when the barrel is secured thereto.

10. The combination of claim 1, comprising also said water source to which said barrel is screwed by means of mating threads on the barrel and source, and a flexible washer forming a passage between said source and disc, the aerator having only one path for possible leakage of water from below the disc to said threads, said path extending along the lower surface of the washer, said top of the diffuser engaging and compressing the washer tightly to close said path when the barrel is screwed to said source.

11. In a water aerator for delivering an aerated bubbly stream, the combination of a cylindrical barrel adapted to be removably secured at its upper portion to a source of water under pressure, a basket mounted in the barrel and surrounding a mixing chamber, screen means supported by the basket below said chamber and through which said stream is adapted to be discharged, said barrel and basket having opposing parts forming a passage for flow of atmospheric air into the mixing chamber due to a reduced pressure therein, a diffuser overlying the mixing chamber and forming a diffuser chamber positioned to receive water from said source, the diffuser chamber being open at the top and having peripheral openings for diffusing a flow of water outwardly from the diffuser chamber to the mixing chamber, the diffuser also having a seat recessed below the top of the diffuser, a flow restrictor disc supported on said seat and having a control opening for admitting water from said source to the diffuser chamber, and means on the diffuser for releasably retaining said restrictor disc against removal from the diffuser, said control opening, diffuser chamber, peripheral openings and mixing chamber forming a path through which water is adapted to flow from said source to said screen means for discharge from the aerator, the diffuser having a raised bottom surrounded by an annular trough bordering an outer wall of the diffuser, said peripheral openings being slots in said wall extending downward from the upper portion of the diffuser to about the level of the bottom of said trough.

12. In a water aerator for delivering an aerated bubbly stream, the combination of a cylindrical barrel adapted to be removably secured at its upper portion to a source of water under pressure, a basket mounted in the barrel and surrounding a mixing chamber, screen means supported by the basket below said chamber and through which said stream is adapted to be discharged, said barrel and basket having opposing parts forming a passage for flow of atmospheric air into the mixing chamber due to a reduced pressure therein, a diffuser overlying the mixing chamber and forming a diffuser chamber positioned to receive water from said source, the diffuser chamber being open at the top and having peripheral openings for diffusing a flow of water outwardly from the diffuser chamber to the mixing chamber, the diffuser also having a seat recessed below the top of the diffuser, a flow restrictor disc supported on said seat and having a control opening for admitting water from said source to the diffuser chamber, and means on the diffuser for releasably retaining said restrictor disc against removal from the diffuser, said control opening, diffuser chamber, peripheral openings and mixing chamber forming a path through which water is adapted to flow from said source to said screen means for discharge from the aerator, said restrictor disc having a burr surrounding said control opening at the lower side of the disc.

13. The combination of claim 12, in which the disc also has a ridge on said one side thereof to identify the side having said burr.

14. The combination of claim 13, in which said ridge is concentric to said control opening.

15. In a water aerator for delivering an aerated bubbly stream, the combination of a cylindrical barrel adapted to be removably secured at its upper portion to a source of water under pressure, a basket mounted in the barrel and surrounding a mixing chamber, screen means supported by the basket below said chamber and through which said stream is adapted to be discharged, said barrel and basket having opposing parts forming a passage for flow of atmospheric air into the mixing chamber due to a reduced pressure therein, a diffuser overlying the mixing chamber and forming a diffuser chamber positioned to receive water from said source, the diffuser chamber being open at the top and having peripheral openings for diffusing a flow of water outwardly from the diffuser chamber to the mixing chamber, the diffuser also having a seat recessed below the top of the diffuser, a flow restrictor disc supported on said seat and having a control opening for admitting water from said source to the diffuser chamber, and means on the diffuser for releasably retaining said restrictor disc against removal from the diffuser, said control opening, diffuser chamber, peripheral openings and mixing chamber forming a path through which water is adapted to flow from said source to said screen means for discharge from the aerator, said combination comprising also a flexible washer located in said barrel above the diffuser and adapted to be compressed against said water source when the barrel is secured thereto, the diffuser having a peripheral flange surrounding said seat and engaging the washer when the restrictor disc is removed from the combination, said seat being recessed to a depth at least as great as the thickness of said disc, whereby the diffuser flange is engageable with the washer to compress the same against said source regardless of whether the restrictor disc is on said seat or is removed from the combination, said releasable retaining means being detents integral with the diffuser flange and overlying the outer portion of the restrictor disc, said disc having a burr surrounding said control opening and located at only one side of the disc, said disc also having a ridge on said one side thereof to identify the side having said burr, said ridge substantially surrounding said control opening in spaced relation thereto.

16. In a water aerator for delivering an aerated bubbly stream, the combination of a cylindrical barrel adapted to be removably secured at its upper portion to a source of water under pressure, a basket mounted in the barrel and surrounding a mixing chamber, screen means supported by the basket below said chamber and through which said stream is adapted to be discharged, said barrel and basket having opposing parts forming a passage for flow of atmospheric air into the mixing chamber due to a reduced pressure therein, a diffuser overlying the mixing chamber and forming a diffuser chamber positioned to receive water from said source, the diffuser chamber being open at the top and having peripheral openings for diffusing a flow of water outwardly from the diffuser chamber to the mixing chamber, the diffuser also having a seat recessed below the top of the diffuser, a flow restrictor disc supported on said seat and having a control opening for admitting water from said source to the diffuser chamber, and means on the diffuser for releasably retaining said restrictor disc against removal from the diffuser, said control opening, diffuser chamber, peripheral openings and mixing chamber forming a path through which water is adapted to flow from said source to said screen means for discharge from the aerator, the combination comprising also a ring surrounding and supporting the diffuser and forming therewith an annular passage for flow of water from said diffuser openings to the mixing chamber, said ring being closely surrounded by the barrel, said basket having an outwardly extending flange seated on a portion of the barrel to support the basket, said ring being supported on said basket flange, and a flexible washer overlying an annular outer portion of the diffuser and engaging the upper end of said ring, said washer being compressible by said ring against said water source when the barrel is secured thereto, the diffuser having a peripheral flange surrounding said seat, said releasable retaining means being detents integral with the diffuser flange and overlying the outer portion of the restrictor disc, said disc having a burr surrounding said control opening and located at only one side of the disc, said disc also having a ridge on said one side thereof to identify the side having said burr, said ridge substantially surrounding said control opening in spaced relation thereto.

17. In a water aerator for delivering an aerated bubbly stream, the combination of a cylindrical barrel adapted to be removably secured at its upper portion to a source of water under pressure, a basket mounted in the barrel and surrounding a mixing chamber, screen means supported by the basket below said chamber and through which said stream is adapted to be discharged, said barrel and basket having opposing parts forming a passage for flow of atmospheric air into the mixing chamber due to a reduced pressure therein, a diffuser overlying the mixing chamber and forming a diffuser chamber positioned to receive water from said source, the diffuser chamber being open at the top and having peripheral openings for diffusing a flow of water outwardly from the diffuser chamber to the mixing chamber, the diffuser also having a seat recessed below the top of the diffuser, a flow restrictor disc supported on said seat and having a control opening for admitting water from said source to the diffuser chamber, and means on the diffuser for releasably retaining said restrictor disc against removal from the diffuser, said control opening, diffuser chamber, peripheral openings and mixing chamber forming a path through which water is adapted to flow from said source to said screen means for discharge from the aerator, said retaining means including resilient elements operable to release the restrictor disc from the diffuser without substantial permanent distortion of the diffuser, whereby said diffuser after removal of the disc therefrom is adapted for reuse in the aerator to provide unimpaired operation thereof without the flow restriction imposed by said disc.

* * * * *